US006745414B2

(12) United States Patent
Zhou

(10) Patent No.: US 6,745,414 B2
(45) Date of Patent: Jun. 8, 2004

(54) PORTABLE SHOWER STATION

(75) Inventor: Ronghua Zhou, Reno, NV (US)

(73) Assignee: Haws Drinking Faucet Company, Sparks, NV (US)

( * ) Notice: Subject to any disclaimer, the term of this patent is extended or adjusted under 35 U.S.C. 154(b) by 0 days.

(21) Appl. No.: 10/371,613

(22) Filed: Feb. 19, 2003

(65) Prior Publication Data

US 2003/0163867 A1 Sep. 4, 2003

Related U.S. Application Data

(60) Provisional application No. 60/361,228, filed on Mar. 1, 2002.

(51) Int. Cl.[7] ..... A47K 3/28

(52) U.S. Cl. ..... 4/599; 4/601; 4/900

(58) Field of Search ..... 4/596, 599, 601, 4/602, 603, 615, 900; 239/279, 280, 280.5, 281, 450

(56) References Cited

U.S. PATENT DOCUMENTS

| | | | | |
|---|---|---|---|---|
| 2,778,031 A | * | 1/1957 | Logan | 4/601 |
| 3,925,828 A | | 12/1975 | Kim | |
| 4,787,875 A | | 11/1988 | Baron et al. | |
| 5,216,763 A | | 6/1993 | Grenier | |
| 5,311,620 A | | 5/1994 | Ratje | |
| 5,315,721 A | | 5/1994 | Okun | |
| 5,469,587 A | | 11/1995 | Demeny | |
| 5,497,633 A | | 3/1996 | Jones et al. | |
| 5,564,138 A | | 10/1996 | Simpson | |
| 5,598,719 A | | 2/1997 | Jones et al. | |
| 5,649,867 A | | 7/1997 | Briggs | |
| 5,820,472 A | | 10/1998 | Briggs | |
| 6,192,633 B1 | | 2/2001 | Hilbert | |

FOREIGN PATENT DOCUMENTS

| | | | | |
|---|---|---|---|---|
| FR | 2513871 | * | 4/1983 | 4/601 |
| GB | 2179549 | * | 3/1987 | 4/599 |

* cited by examiner

*Primary Examiner*—Robert M. Fetsuga
(74) *Attorney, Agent, or Firm*—Kelly Bauersfeld Lowry & Kelley, LLP

(57) ABSTRACT

A portable and rapidly deployable shower station is provided particularly for emergency wash-down use, such as flush-flow decontamination of a person exposed to hazardous materials such as hazardous chemical agents or the like. The shower station includes a plurality of tubular frame components adapted for quick and easy assembly to define an interior shower stall. The frame components incorporate a plurality of upright telescopic tubular posts having their upper ends interconnected by a flexible hose, wherein these telescopic posts are extensible upon connection to a supply of water under pressure to raise the flexible hose to an elevated position at the top of the shower stall. The tubular posts and the flexible hose carry a plurality of spray nozzles for delivering a substantial water flow projected from multiple locations and in multiple directions into the shower stall.

24 Claims, 6 Drawing Sheets

PORTABLE SHOWER STATION

This application claims the benefit of U.S. Provisional Application No. 60/361,228, filed Mar. 1, 2002.

BACKGROUND OF THE INVENTION

This invention relates generally to emergency shower units of a type designed principally for flush-flow wash-down as an initial first aid measure for a person or persons who may have been exposed to hazardous materials such as toxic chemical agents or the like. More specifically, this invention relates to a portable shower station designed for convenient transport to a site of potential use where it can be rapidly deployed to provide effective flush-flow wash-down.

Significant attention has been directed in recent years to problems associated with exposure to a wide range of toxic chemical and/or biological agents known or suspected to produce adverse medical conditions in humans. Such chemical and/or biological agents, commonly referred to as hazardous materials, are widely used in many industrial applications, laboratory environments, etc., whereby undesired exposure can occur in the event of accidental spillage during use, or during handling and transport of a hazardous material. In addition, exposure to hazardous materials may occur in the course of military action, or as a result of terrorist activity. When an exposure incident occurs, particularly with certain hazardous agents, a typical first step in the decontamination process can be to wash the exposed person and clothing with a substantial flushing flow of water, wherein it can be important for this flush-flow wash-down to take place as soon as possible after exposure.

A variety of emergency shower units have been developed with the intent of providing flush-flow wash-down of a person or persons exposed to hazardous materials. In general, these emergency shower units have provided a shower stall adapted for connection to a supply of water under pressure to one or more spray nozzles for flushing contaminants from a person. In some designs, these shower units have been provided in a collapsible and portable form conducive to convenient transport to a potential site of use, whereat the shower unit is adapted for assembly and use. See, for example, U.S. Pat. Nos. 5,216,763 and 5,469,587. However, these prior shower assemblies have typically included a relatively large number of component parts, and/or have not been ideally suited for fast assembly in an intuitive manner for rapid deployment in an emergency situation. In addition, some of these prior shower assemblies have been constructed from a large number of flexible components that do not provide sufficient structural stiffness and stability in the erected state for outdoor use during windy weather conditions.

The present invention pertains to an improved emergency shower unit or station constructed from a substantial minimum number of component parts suitable for convenient and compact transport to a potential use site, and designed for quick and easy on-site assembly in an emergency environment to provide a substantially rigid shower stall structure with multiple spray nozzles for flush-flow wash-down of a person exposed to a hazardous material.

SUMMARY OF THE INVENTION

In accordance with the invention, a portable and rapidly deployable shower station is provided particularly for emergency flush-flow wash-down of a person exposed to hazardous materials such as hazardous chemical agents or the like. The shower station comprises a plurality of tubular frame components adapted for quick and easy assembly to form a substantially rigid structure defining an interior shower stall. These tubular frame components are adapted for connection to a supply of water under pressure wherein the water pressure displaces the assembled frame components from a compact collapsed configuration to a fully erected state defining the interior shower stall. A plurality of spray nozzles are carried by the frame components for delivering a substantial flush-flow of water to a person standing within the shower stall.

In a preferred form, the frame components of the portable shower station comprise a lower base frame including at least one frame member such as a pair of rigid tubular side rails interconnected at one end by a rigid tubular cross rail, by means of interfitting quick connect-disconnect fittings suitable for rapid assembly to define an interconnected water flow passage therethrough. The opposite ends of each of the two side rails are connected respectively by means of additional quick connect-disconnect fittings to a plurality of upright telescopic tubular corner posts defining internal water flow passage in flow communication with said base frame. The upper ends of these corner posts are connected in turn to a nonrigid top frame comprising a plurality of flexible hose segments defining internal water flow passages in flow communication with said corner post passages and extending inwardly from the corner posts to a generally X-shaped central connector fitting.

At least one of the base frame components is adapted for rapid connection by connecting means to a supply of water under pressure, for water flow upwardly through the plurality of telescopic corner posts and the nonrigid top frame. The water pressure automatically and hydraulically causes the corner posts to extend from a normal retracted or collapsed configuration to an elongated or extended and fully erected state. In addition, the water pressure effectively inflates and substantially rigidifies the flexible hose segments of the top frame. In this fully erected state, the frame components cooperatively provide a substantially rigid shower structure suitable for outdoor use during windy conditions. In use, the multiple spray nozzles carried by the corner posts and preferably also by the top frame deliver a substantial water flow from multiple locations and projected from different directions into the interior shower stall to provide effective flush-flow wash-down of a person within the shower stall. A shower curtain can be draped from the frame components to enclose one or more sides of the shower stall, if desired.

Other features and advantages of the invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
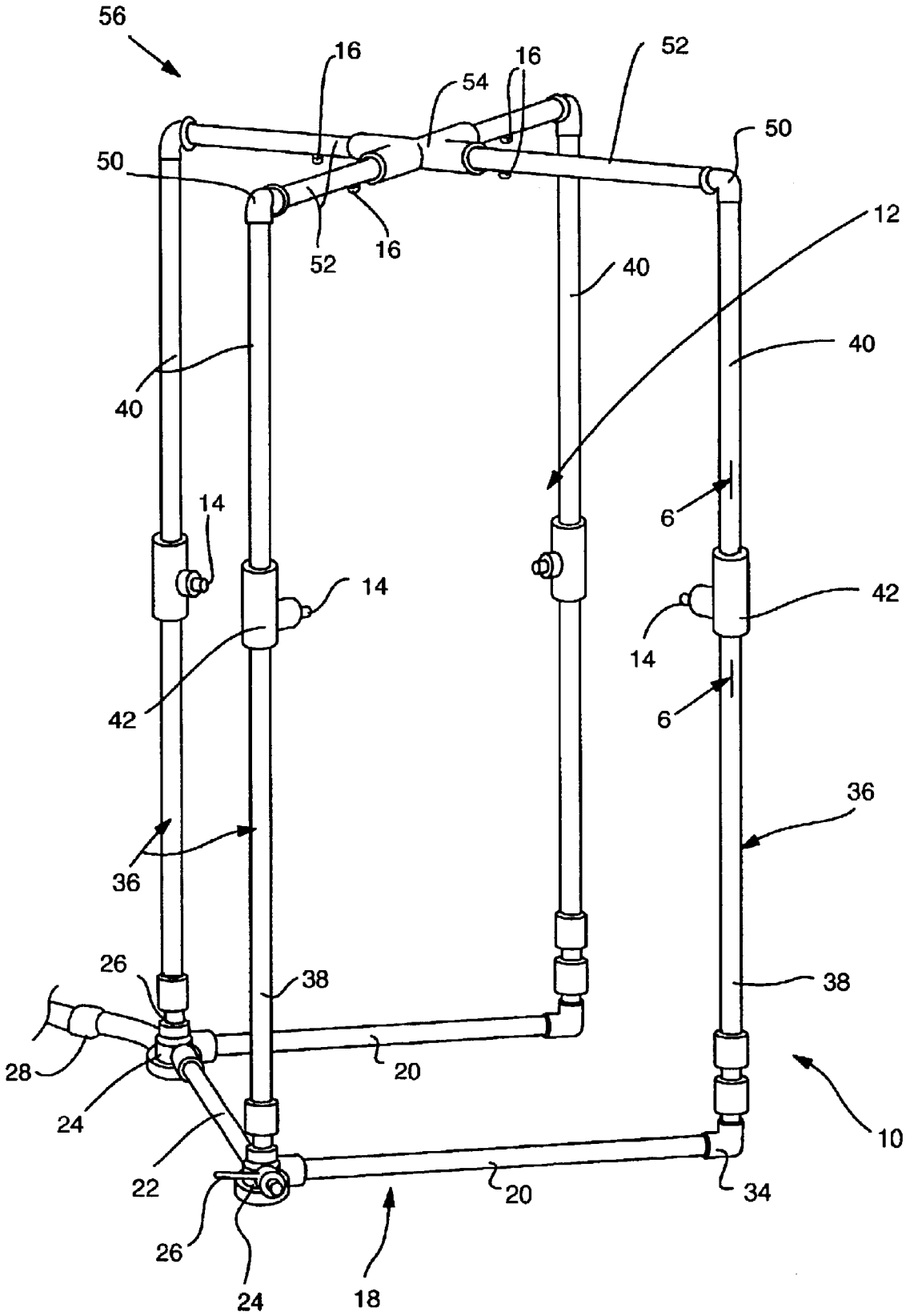
FIG. 1 is a perspective view of a portable shower station embodying the novel features of the invention, and illustrating the shower station in a deployed and operational configuration.

As shown in the exemplary drawings, a portable shower station referred to generally in FIGS. 1–5 by the reference numeral 10 is provided for convenient transport in a disassembled state (FIG. 2) to a site of use whereat the shower station components can be rapidly assembled and deployed (FIGS. 1 and 3–5). The portable shower station 10 is designed primarily for use in an emergency environment or the like to provide a substantial flush-flow of water for wash-down of a person exposed to a hazardous material such as a toxic chemical agent.

The portable shower station 10 of the present invention generally comprises a plurality of tubular frame components which, in a disassembled state, can be stored in a compact space typically encased within a carrying case or bag (not shown) having a size approximating the size of a conventional golf bag. These tubular frame components are constructed from relatively lightweight materials, such as plastic PVC pipe or the like, for convenient transport to a potential use site. Importantly, the frame components are designed for rapid and simple assembly in an intuitive manner, and for quick and easy connection to a supply of water under pressure, to provide a pressure-erected and substantially rigid shower structure defining an interior shower stall 12 (FIGS. 1 and 5) into which a substantial flush-flow of water is directed from a plurality of spray nozzles 14 and 16 (FIG. 1).

Figure 2:
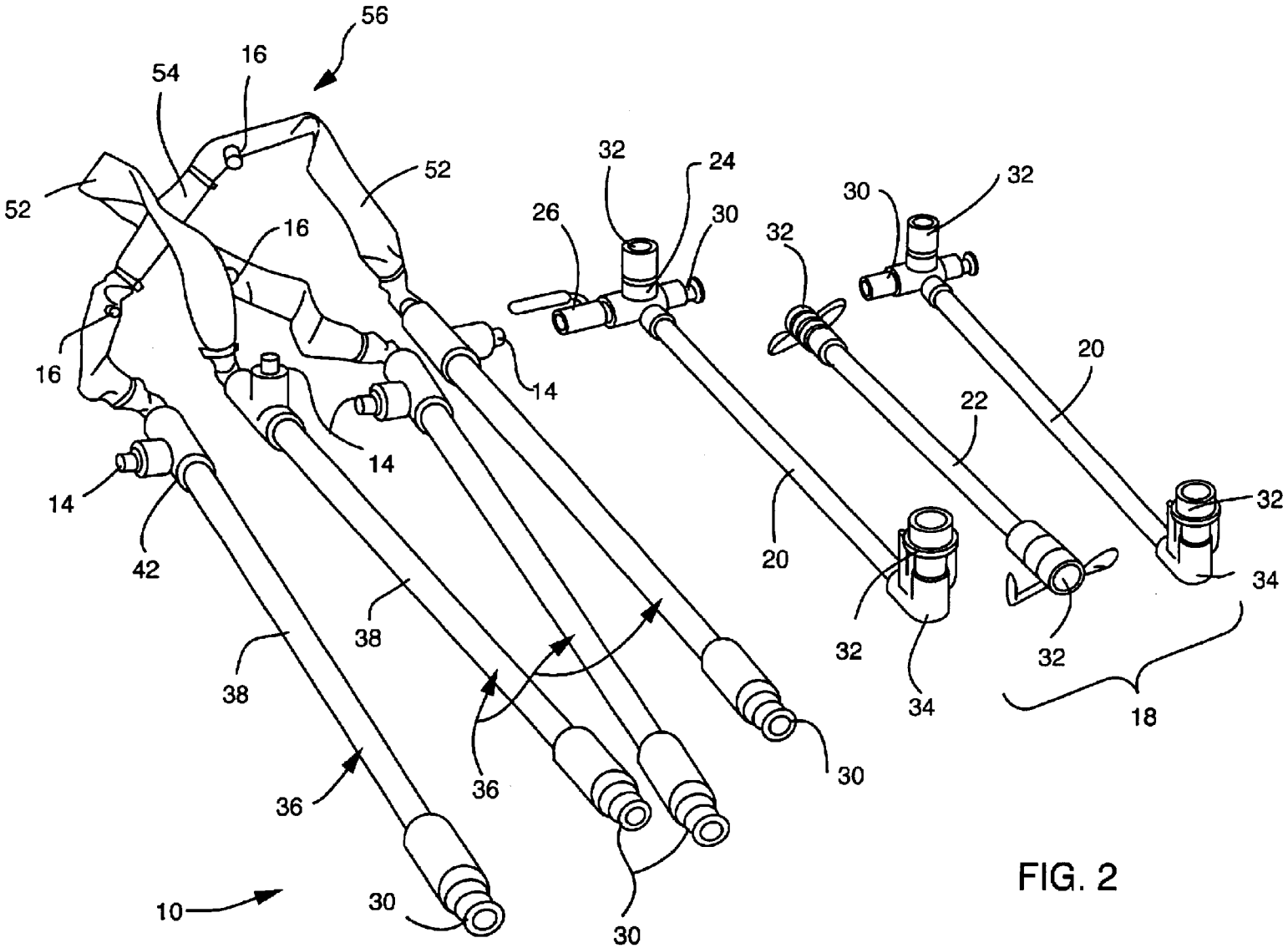
FIG. 2 is a perspective view depicting the components of the portable shower station in an unassembled array.
Figure 3:
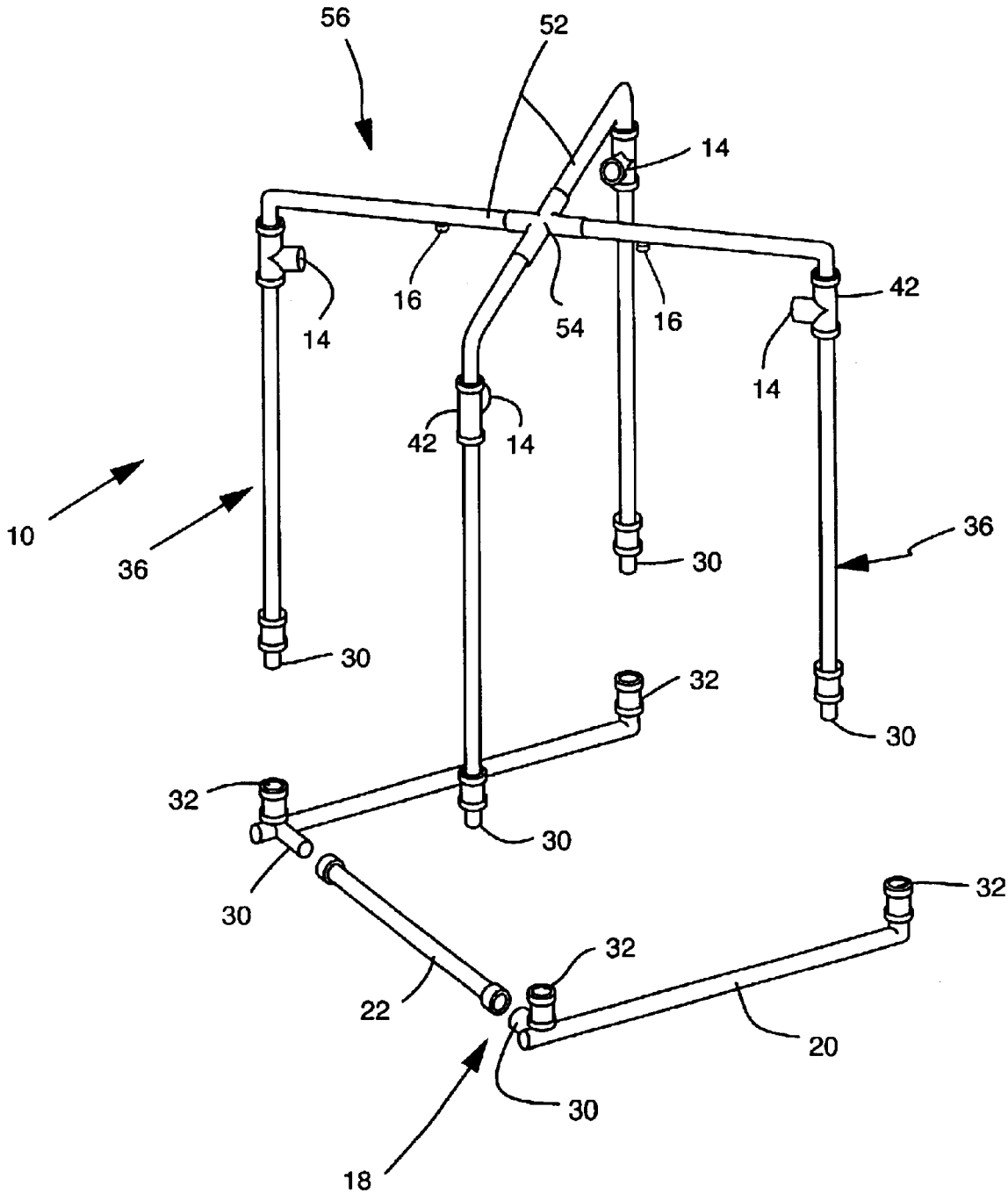
FIG. 3 is an exploded perspective view of the shower station components to illustrate quick connect assembly thereof.
Figure 4:
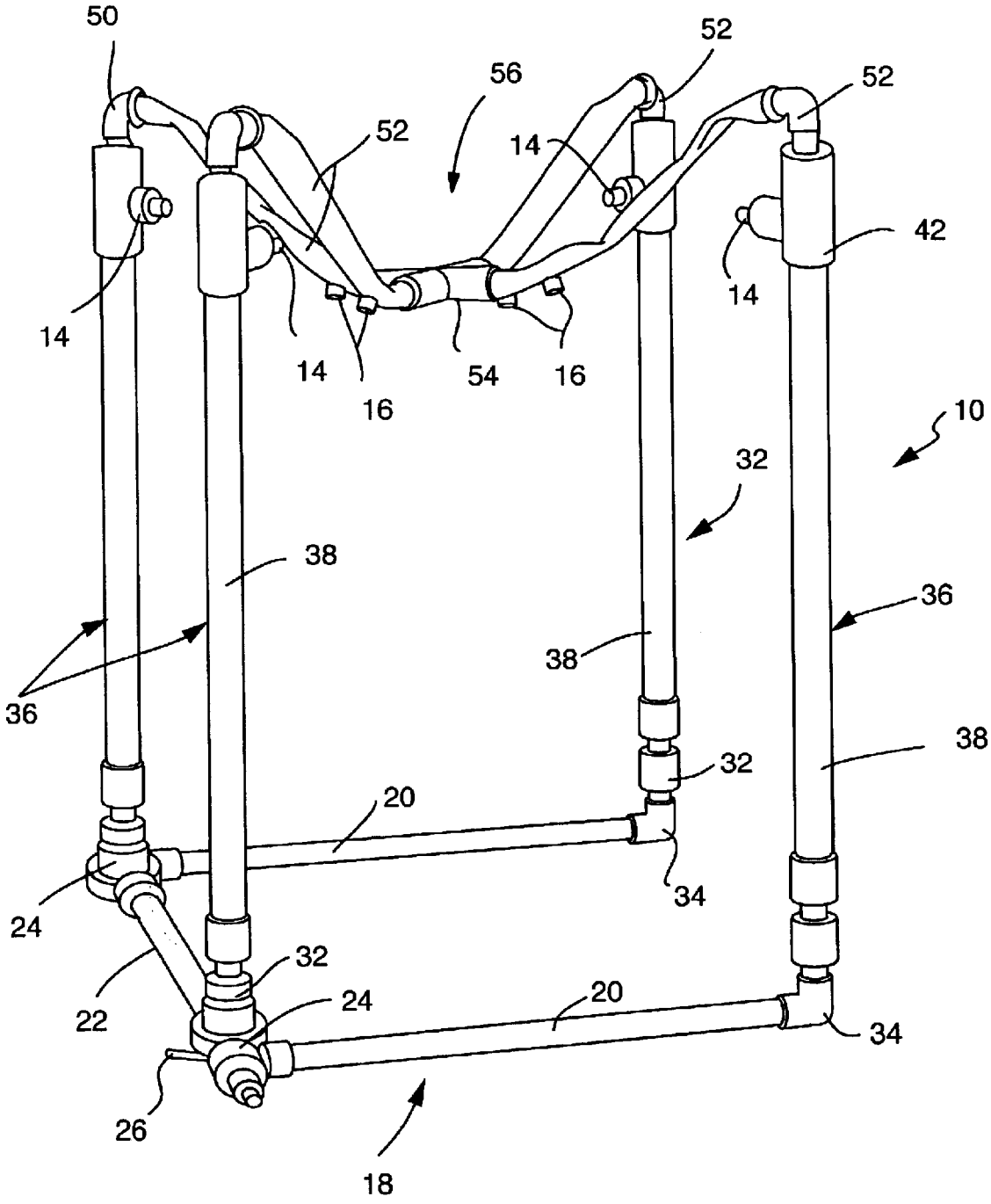
FIG. 4 is a perspective view of the shower station, similar to FIG. 1, but showing the shower station in a nonoperational configuration prior to connection thereof to a supply of water under pressure.
Figure 5:
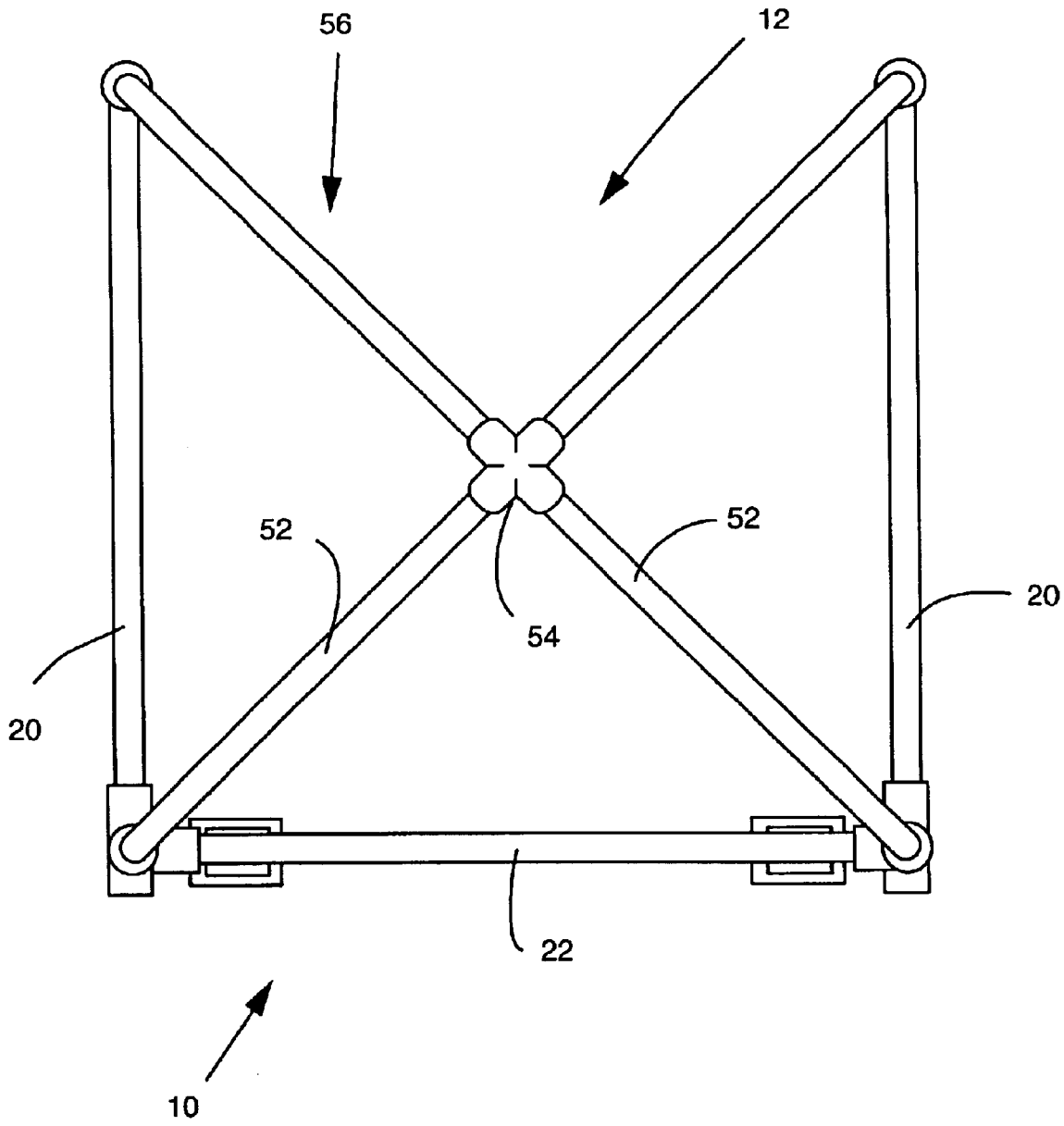
FIG. 5 is a top plan view of the assembled shower station as viewed in FIG. 1.

As shown best in FIGS. 2–4, the tubular frame components of the portable shower station 10 include a lower base frame 18 comprising a pair of rigid tubular side rails 20 adapted for interconnection at one end by a transversely extending cross rail 22. In one preferred configuration, these side rails 20 and the cross rail 22 are formed from schedule 80 PVC pipe having a size of 1½ inch. A pair of connector fittings 24 are mounted respectively at one end of the two side rails 20, with at least one and preferably both of these connector fittings 24 being adapted for convenient coupling via a shut-off valve 26 (FIGS. 2 and 4) and a hose 28 (FIG. 1) or the like with a supply of water under pressure. These connector fittings 24 additionally define a pair of male and female coupling members 30 and 32 (FIG. 2) of a conventional quick connect-disconnect coupling. The male coupling members extend transversely for suitable connection with additional mating female coupling members 32 carried at the opposite ends of the cross rail 22, for quickly and easily interconnecting the cross rail 22 between the side rails 20 to form a stable three-sided base for the shower structure. The female coupling members 32 of each connector fitting 24 extend upwardly for connection to other frame components, as will be described. An elbow fitting 34 is mounted at the opposite end of each side rail 22 and carries another upwardly extending female coupling member 32 for connection to other frame components.

Figure 6:
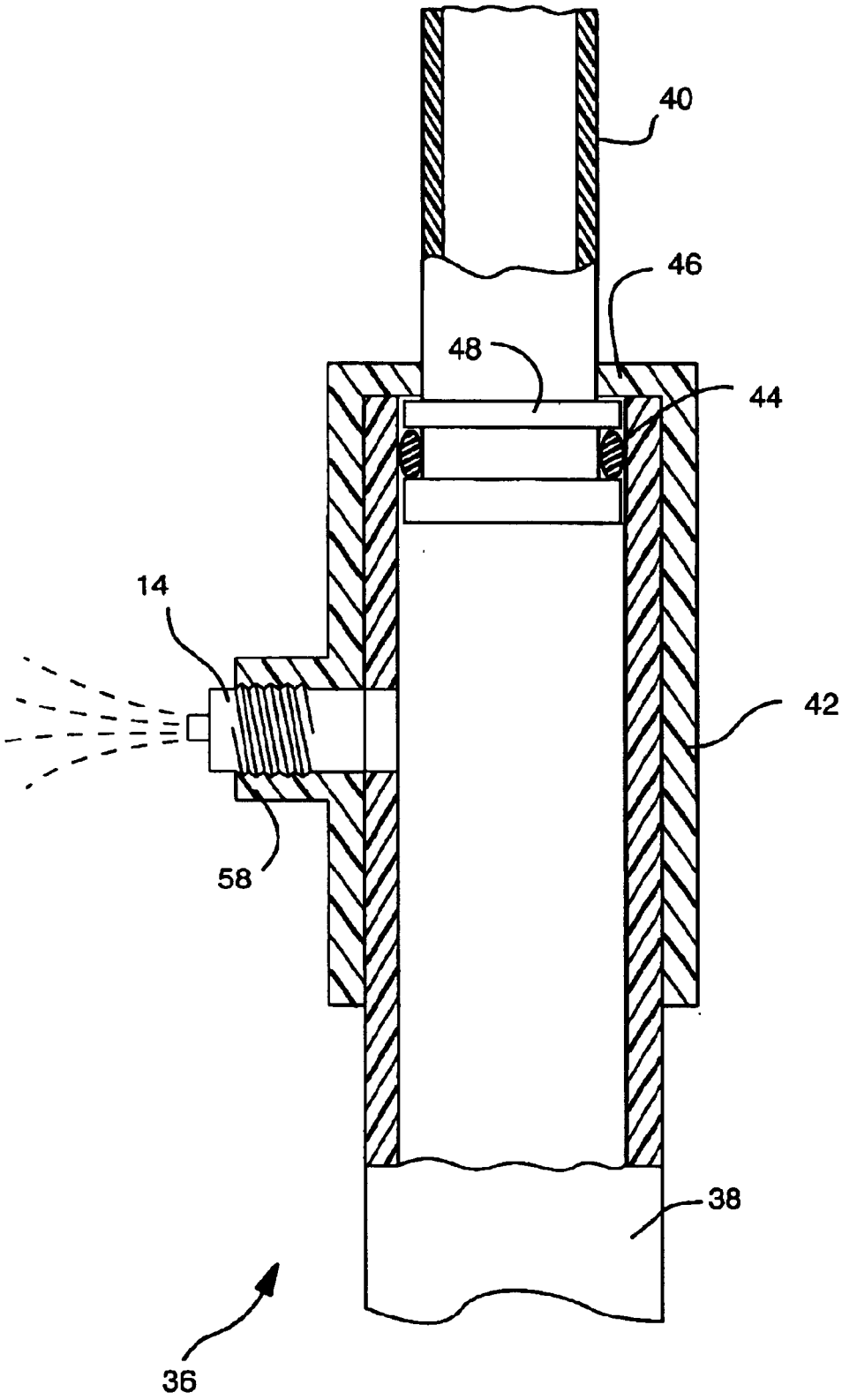
FIG. 6 is an enlarged fragmented sectional view taken generally on the line 6—6 of FIG. 1.

The upwardly presented female coupling members 32 at the opposing ends of the two side rails 22 are designed for quick connect-disconnect assembly with mating male coupling members 30 mounted at the lower ends of a plurality of telescopic corner posts 36, again as shown best in FIG. 2. As shown in accordance with the preferred form of the invention, each corner post 36 is formed by a lower cylinder or tube 38 which can also be formed from schedule 80 PVC pipe having a size of 1½ inch, and slidably receives therein an upper tube 40 such as a length of schedule 80 PVC pipe having a size of 1 inch. FIGS. 2–4 show the upper tube 40 in a position retracted substantially into the lower cylinder 38, whereas FIG. 1 shows the upper tube 40 extended and projecting upwardly from the lower cylinder 38. A tee fitting 42 at the upper end of the lower cylinder 38 of each corner post 36 slidably receives the upper tube 40 and incorporates at least one seal such as an O-ring seal 44 (FIG. 6) to substantially prevent water leakage therebetween. In addition, the upper end of this tee fitting 42 includes a radially inwardly turned stop 46 for engaging a flange 48 near the lower end of the upper tube 40, when the upper tube 40 is in the extended position, to prevent separation of the upper tube 40 from the lower cylinder 38.

The upper end of each corner post 36, as defined by the upper end of the associated upper tube 40 thereof, is connected by an inwardly turned elbow fitting 50 to a flexible hose segment 52 formed from a relatively sturdy yet flexible and preferably reinforced hose material having a diametric size of about 1½ inch. As shown, each hose segment 52 extends inwardly from the upper end of the associated corner post 36, and has an inner end coupled in turn to a central X-shaped connector fitting 54. The connector fitting 54, together with the hose segments 52, defines a top frame 56 for the shower structure.

The multiple spray nozzles 14 and 16 are mounted on the frame components at different positions to provide multiple water sprays discharged into the shower stall 12 from different positions and directions. In the illustrative embodiment as shown, each of the tee fittings 42 of the corner posts 36 includes an inwardly directed fitting leg 58 (FIG. 6) having one of the spray nozzles 14 mounted thereon. Thus, as shown, four of the spray nozzles 14 are mounted at the four corners of the shower stall 12 for providing inwardly directed sprays at a substantially mid-height location. The spray nozzles 16 are shown mounted along the lengths of the hose segments 52 and thus provide downwardly directed sprays from different positions on the top frame 56. Persons skilled in the art will recognize, however, that the specific number and locations of the spray nozzles 14 and 16 may vary.

In the unassembled state, as viewed in FIG. 2, the shower station 10 thus comprises a relatively small number of component parts that are relatively lightweight and compact. The corner posts 36 are each stored in the retracted configuration with the upper tube 40 retracted substantially into the associated lower cylinder 38. Importantly, the top frame 56 including the flexible hose segments 52 is and remains preassembled with the corner posts 36.

When shower deployment is desired, the two side rails 20 are quickly and easily assembled with the cross rail 22 by means of the quick connect fittings 30, 32 thereon to provide the substantially rigid and stable three-sided tubular lower base frame 18. The four corner posts 36 are then quickly and easily assembled with the lower base frame 18, again by means of the quick connect fittings 30, 32 thereon, to form the shower structure in a collapsed configuration as viewed in FIG. 4. Then, by connecting the tubular frame structure to the supply of water under pressure by means of one of the valves 26, the water under pressure automatically displaces the frame structure from the collapsed configuration to the extended or fully erected configuration (FIG. 1) and water is sprayed into the shower stall 12 via the spray nozzles 14 and 16. More particularly, the pressurized water supply is communicated through the base frame side rails 20 and cross rail 22 to each of the four upstanding corner posts 36, resulting in pressure-forced elongation or extension of each of the upper tubes 40 to the elevated, fully erect position. Such elevation of the upper tubes 40 of the corner posts 36 lifts the top frame 56 to form the substantially rectangular and substantially rigid shower structure enclosing the interior shower stall 12, as viewed in FIG. 1. Concurrently with movement of the frame components to the fully erect position, the lower ends of the upper tubes displace upwardly beyond the tee fittings 58 so that the water under pressure can flow through the associated spray nozzles 14. Additionally, the water under pressure flows upwardly through the upper tubes 40 and the top frame 56 to the upper spray nozzles 16. The combined water spray through the nozzles 14 and 16 provides the desired substantial flush-flow of water directed into the shower stall.

An individual can step quickly and easily into the shower stall 12 for flush-slow wash-down. If desired, a shower curtain (not shown) can be draped onto the erected shower frame structure to enclose one or more sides of the shower stall. Conveniently, when the pressurized water supply is turned off, the flexible hose segments 52 of the top frame 56 will sag to pull inwardly on the uppermost ends of the upper tubes 40, thereby slightly cocking those tubes 40 relative to the lower cylinders 38 of the corner posts 36, so that the corner posts will tend to remain in the elevated and fully erected configuration. If desired, additional mechanical means such as a thumbscrew (not shown) of the like may be provided for releasibly locking the corner posts 36 in the fully erected state, following initial pressure-forced deployment, so that the water supply may be turned off without resultant movement of the corner posts 36 back to the collapsed configuration. When use of the shower station is concluded, the corner posts 36 can be quickly and easily guided manually back to the retracted state followed by similarly quick and easy disassembly of the frame components.

A variety of modifications and improvements in and to the portable shower station of the present invention will be apparent to those persons skilled in the art. For example, while the intended primary use pertains to emergency flush-flow wash down of persons exposed to certain hazardous materials, it will be recognized and understood that the invention may be employed in alternative portable shower applications, such as in treatment of persons for heat exposure, or for use in non-emergency environments such as a camping or beach environment. Accordingly, no limitation on the invention is intended by way of the foregoing description and accompanying drawings, except as set forth in the appended claims.

What is claimed is:

1. A portable shower station for connection to a supply of water under pressure, said shower station comprising:

a base frame;

a plurality of telescopic tubular posts having lower ends connected to and upstanding from said base frame;

a flexible top frame connected to upper ends of said tubular posts;

means for connecting said shower station to a supply of water under pressure for flow of water under pressure through said tubular posts and said flexible top frame, for pressure-forced extension of said tubular posts and for substantially rigidifying said flexible top frame, whereby said extended tubular posts and said rigidified top frame cooperatively define an interior shower stall; and at least one spray nozzle carried by one of said tubular posts and said top frame for spraying a portion of the water connected thereto into said shower stall.

2. The portable shower station of claim 1 wherein each of said telescopic tubular posts is removably connected to said base frame.

3. The portable shower station of claim 1 wherein said base frame comprises at least one tubular base frame member, said means for connecting said shower station to the supply of water under pressure comprising means for connecting said at least one tubular base frame member to the water supply for flow of water under pressure into said at least one tubular base frame member and further through said tubular posts and said top frame.

4. The portable shower station of claim 3 further including quick connect-disconnect means for removably connecting said tubular posts to said at least one tubular base frame member.

5. The portable shower station of claim 3 wherein said water supply connecting means further includes a shut-off valve.

6. The portable shower station of claim 1 wherein said base frame comprises a pair of tubular side rails, and at least one tubular cross rail connected therebetween, said plurality of telescopic tubular posts having lower ends connected respectively to said side rails, said water supply connecting means including means for connecting said base frame to the supply of water under pressure for flow therethrough and through said tubular posts and said top frame.

7. The portable shower station of claim 6 further including quick connect-disconnect means for removably connecting said cross rail to said side rails, and for removably connecting said tubular posts to said side rails.

8. The portable shower station of claim 1 wherein each of said tubular posts comprises a relatively large diameter lower cylinder having a lower end removably connected to said base frame, and a comparatively smaller diameter extension tube retractably received therein and having an upper end connected to said top frame.

9. The portable shower station of claim 1 wherein said at least one spray nozzle comprises a plurality of spray nozzles carried on said tubular posts and said top frame.

10. The portable shower station of claim 1 wherein said flexible top frame comprises a plurality of flexible hose segments connected respectively to said upper ends of said tubular posts.

11. A portable shower station for connection to a supply of water under pressure, said shower station comprising:

a base frame including interconnected tubular base frame components adapted for connection to a supply of water under pressure;

a plurality of telescopic tubular corner posts having lower ends connected to and upstanding from said base frame, with said corner posts defining internal water flow passages in flow communication with said base frame;

a flexible top frame connected to upper ends of said tubular corner posts and defining internal water flow passages in flow communication with said corner post passages;

said tubular corner posts being hydraulically extended and said flexible top frame being substantially rigidified upon connection of said base frame to a supply of water under pressure, whereby said extended tubular corner posts and said rigidified top frame cooperate with said base frame to define an interior shower stall; and at least one spray nozzle carried by at least one of said tubular corner posts and said top frame for spraying a portion of the water connected thereto into said shower stall.

12. The portable shower station of claim 11 wherein each of said telescopic tubular posts is removably connected to said base frame by a quick connect-disconnect fitting.

13. The portable shower station of claim 11 further including a shut-off valve for selectively connecting said base frame to a supply of water under pressure.

14. The portable shower station of claim 11 wherein said base frame comprises a pair of tubular side rails, and at least one tubular cross rail connected therebetween, said plurality of telescopic tubular corner posts having lower ends removably connected respectively generally to opposite ends of said pair of side rails.

15. The portable shower station of claim 14 further including quick connect-disconnect means for removably connecting said cross rail to said side rails, and for removably connecting said tubular posts to said base frame.

16. The portable shower station of claim 1 wherein each of said tubular corner posts comprises a relatively large diameter lower cylinder having a lower end connected to said base frame, and a comparatively smaller diameter extension tube retractably received therein and having an upper end connected to said top frame.

17. The portable shower station of claim 11 wherein said at least one spray nozzle comprises a plurality of spray nozzles carried on said tubular corner posts and said top frame.

18. The portable shower station of claim 11 wherein said flexible top frame comprises a plurality of flexible hose segments connected respectively to said upper ends of said tubular corner posts.

19. A portable shower station for connection to a supply of water under pressure, said shower station comprising:

a base frame including a pair of tubular side rails, at least one tubular cross rail, first quick connect-disconnect fittings for removably interconnecting said cross rail between said side rails to define an interconnected waterflow passage therethrough, and further including means for connecting said base frame to a supply of water under pressure;

a plurality of telescopic tubular corner posts;

second quick connect-disconnect fittings for removably connecting lower ends of said tubular corner posts respectively generally to opposite ends of said side rails with hollow interiors of said tubular corner posts in flow communication with said base frame flow passage;

a flexible top frame connected to upper ends of said tubular corner posts and defining internal water flow passages in flow communication with the hollow interiors of said tubular corner posts;

said tubular corner posts being hydraulically extended and said flexible top frame being substantially rigidified upon connection of said base frame to a supply of water under pressure, whereby said extended tubular corner posts and said rigidified top frame cooperate with said base frame to define an interior shower stall; and at least one spray nozzle carried by at least one of said tubular corner posts and said top frame for spraying a portion of the water connected thereto into said shower stall.

20. The portable shower station of claim 19 wherein said means for connecting said base frame to a supply of water under pressure further includes a shut-off valve.

21. The portable shower station of claim 19 wherein each of said tubular corner posts comprises a relatively large diameter lower cylinder having a lower end connected to said base frame, and a comparatively smaller diameter extension tube retractably received therein and having an upper end connected to said top frame.

22. The portable shower station of claim 19 wherein said at least one spray nozzle comprises at least one spray nozzle carried by each of said plurality of tubular corner posts for spraying water generally laterally into said shower stall.

23. The portable shower station of claim 22 wherein said at least one spray nozzle further comprises at least one spray nozzle carried by said top frame for spraying water generally downwardly into said shower stall.

24. The portable shower station of claim 19 wherein said flexible top frame comprises a plurality of flexible hose segments having outboard ends connected respectively to said upper ends of said tubular corner posts, and inboard ends connected respectively to a generally X-shaped tubular connector fitting.

* * * * *